US006493950B1

(12) United States Patent
Kludjian et al.

(10) Patent No.: US 6,493,950 B1
(45) Date of Patent: Dec. 17, 2002

(54) ROLLING RAZOR AND SHAVING METHOD

(75) Inventors: David J. Kludjian, Marina Del Rey, CA (US); Leon Coresh, Marina Del Rey, CA (US)

(73) Assignee: Rolling Razor, L.L.C., Marina del Ray, CA (US)

( * ) Notice: Subject to any disclaimer, the term of this patent is extended or adjusted under 35 U.S.C. 154(b) by 0 days.

(21) Appl. No.: 09/603,816

(22) Filed: Jun. 23, 2000

(51) Int. Cl.[7] ..... B26B 21/02; B26B 21/52
(52) U.S. Cl. ..... 30/526; 30/50; 30/298
(58) Field of Search ..... 30/50, 34.1, 47, 30/526, 298

(56) References Cited

U.S. PATENT DOCUMENTS 4,989,328 A 2/1991 Sokoloff
5,865,189 A 2/1999 Andrews
6,018,877 A 2/2000 Greene
6,141,875 A * 11/2000 Andrews ..... 30/50

FOREIGN PATENT DOCUMENTS

GB 2265105 A 9/1993
GB 2265105 * 9/1993 ..... 30/50

* cited by examiner

*Primary Examiner*—Douglas D. Watts
(74) *Attorney, Agent, or Firm*—Blakely, Sokoloff, Taylor & Zafman, LLP

(57) ABSTRACT

A razor handle, shaving system and shaving device whereby precise finger-tip control of the pitch, angle and pressure applied the fixed or replaceable shaving blades may be precisely controlled via the incremental movement of a ring shaped cylindrical handle.

13 Claims, 6 Drawing Sheets

ROLLING RAZOR AND SHAVING METHOD

BACKGROUND OF THE INVENTION

1. Field of the Invention

This present invention relates to a novel razor for shaving, and more particularly to a novel handle which provides for precise incremental rotational movement of the single or dual blades systems. This invention also provides a novel method of shaving resulting from the unique features of the rolling razor handle.

2. Related Art

Razors for shaving, both disposable razors and cartridge systems, are well known in the art. A commonality found in the prior art is the elongated handle, it may be wide, it may be narrow and it is often surfaced for better gripping, but the razor head, whether it be single, dual or triple blades is supported on an elongated substantially stick-like member such as those illustrated in U.S. Pat. No. 4,026,016 issued to Nissen and U.S. Pat. No. 5,953,824 issued to Ferraro.

Certain restrictions and limitations arise from the stick nature of an elongated handle used with a shaving system. It is difficult to accommodate the changing contours of the human face and the changing growth patterns of facial hair using a stick handle razor. Finger tip gripping of a stick handle may allow for greater maneuverability but the trade-off is to greatly limit control. To compensate for the inherent limitations of stick-like handles both the Nissen and Ferraro patents illustrate pivoting and swiveling shaving heads affixed to a stick-like handle.

Dual headed razors are found in the art. U.S. Pat. No. 4,989,328 issued to Sokoloff, teaches a full sized blade coupled with a reduced size trimming blade, mounted opposite each other for easy access. The Sokoloff razor is not intended as a bidirectional device.

A purportedly bidirectional razor for shaving is described in U.S. Pat. No. 5,865,189 issued to Andrews. The Andrews systems illustrates a pair of mirror image blades on a stick handle and a method of pushing and pulling the blades against ones skin by moving the handle in one direction and then another. Aside from control problems with pushing a razor blade at the end of a stick handle up and against ones face and the associated instability and lack of control no mention suggestion or illustration of a ring shaped rotatable handle is taught therein, nor is a method of shaving using bidirectional movement by rolling the handle around the forefinger thereby always utilizing a controlled pulling action to shave.

Other novel feature or improvements from the prior art include the ergonomic ring shaped handle, finger mounting and precise pitch control.

SUMMARY OF INVENTION

Accordingly, it is an object of the invention to provide a novel shaving device.

It is yet another object of the invention to provide a novel shaving method.

It is yet another object of the invention to provide a novel single shaving head device.

It is yet another object of the invention to provide a novel dual shaving head device.

It is yet another object of the invention to provide a novel single shaving head method.

It is yet another object of the invention to provide a novel dual shaving head method.

It is yet another object of the invention to provide a novel disposable shaving device.

It is yet another object of the invention to provide a novel shaving device with replaceable blade cartridges.

It is yet another object of the invention to provide a novel replaceable blade cartridge.

It is yet another object of the invention to provide a novel replaceable blade cartridge mounting system.

It is yet another object of the invention to provide an improved handle for a shaving device.

It is yet another object of the invention to provide a novel ring handle for a shaving device.

It is yet another object of the invention to provide a novel finger insertable handle for a shaving device.

It is yet another object of the invention to provide a novel incrementally rotatable handle for a shaving device.

The features of the invention believed to be novel are set forth with particularity in the appended claim. The invention itself, however, both as to configuration, and method of operation, and the advantages thereof, may be best understood by reference to the following descriptions taken in conjunction with the accompanying drawings.

MODES FOR CARRYING OUT THE INVENTION

Figure 1A:
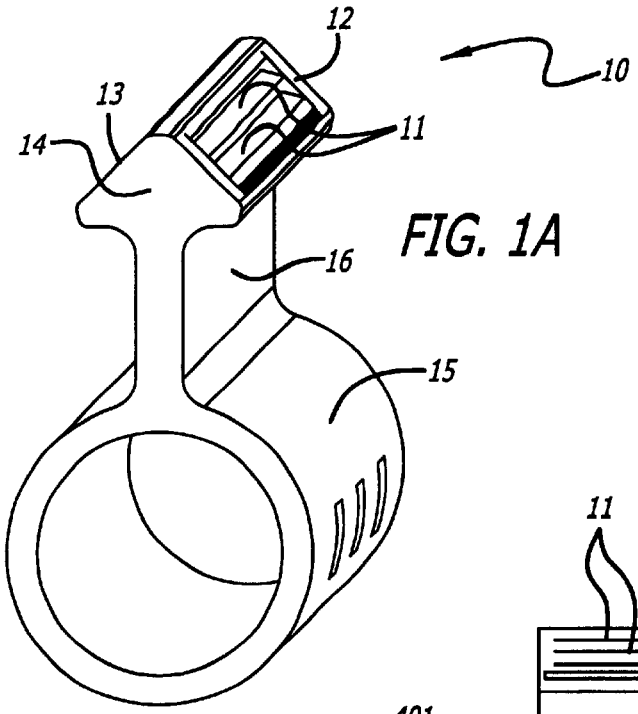
FIG. 1A is a perspective view of the preferred embodiment of the rolling razor.

Referring now to the drawings, there is illustrated in FIG. 1A a perspective view of the rolling razor generally designated 10.

This first embodiment is a disposable razor for shaving. The non-replaceable shaving blades 11 are affixed to the front and back sides 12 & 13 of the bidirectional shaving head 14 which is connected to the ring shaped handle 15 via a short planar member forming a neck 16.

A user will hold the rolling razor 10 in his hand 400 by inserting his index finger 401 inside the ring shaped handle 15. The thumb 402 and middle finger 403 rest against opposite sides of the outer surface of the ring shaped handle 15 and are used to incrementally control the rotation of the bidirectional shaving head 14 in relation to the index finger 401, by rolling the ring shaped handle 15 with the thumb 402 and middle finger 403.

Figure 1D:
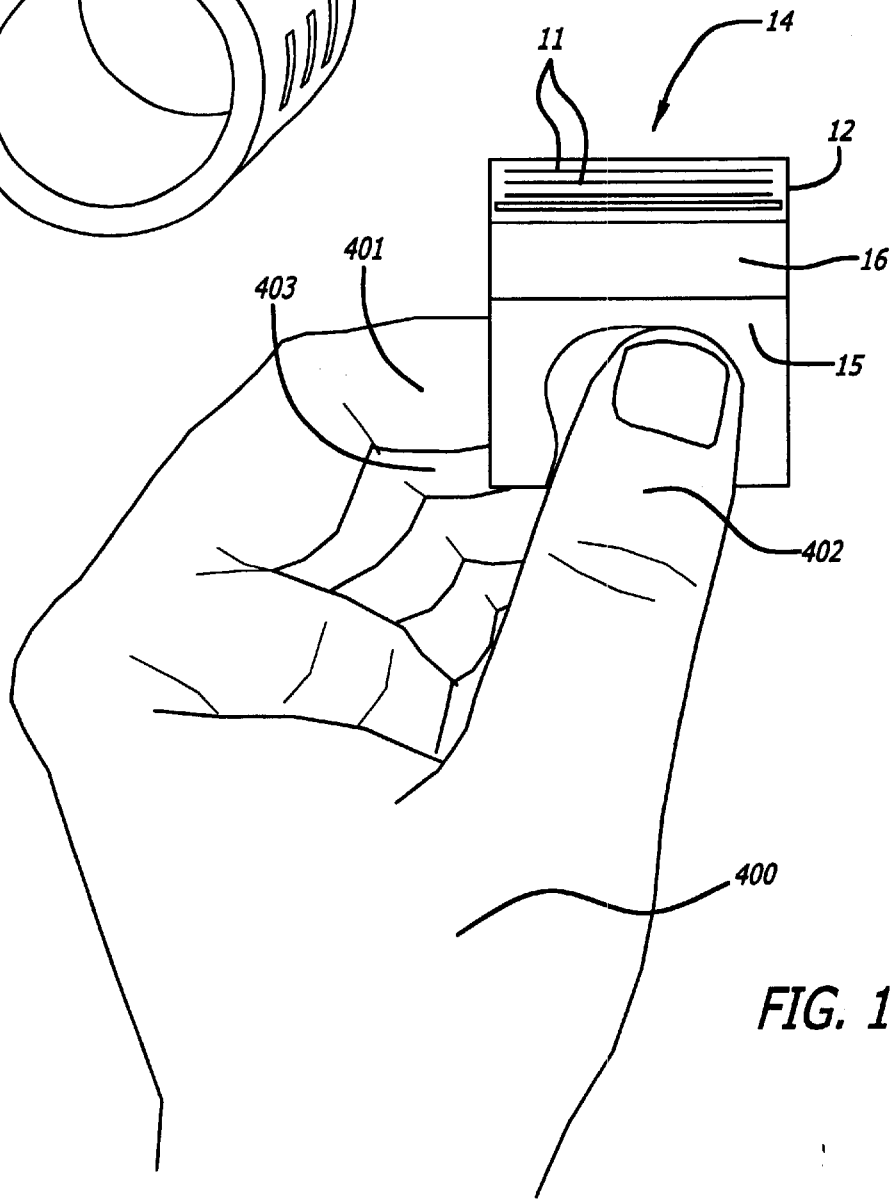
FIG. 1D is a front view of the preferred embodiment.
Figure 1C:
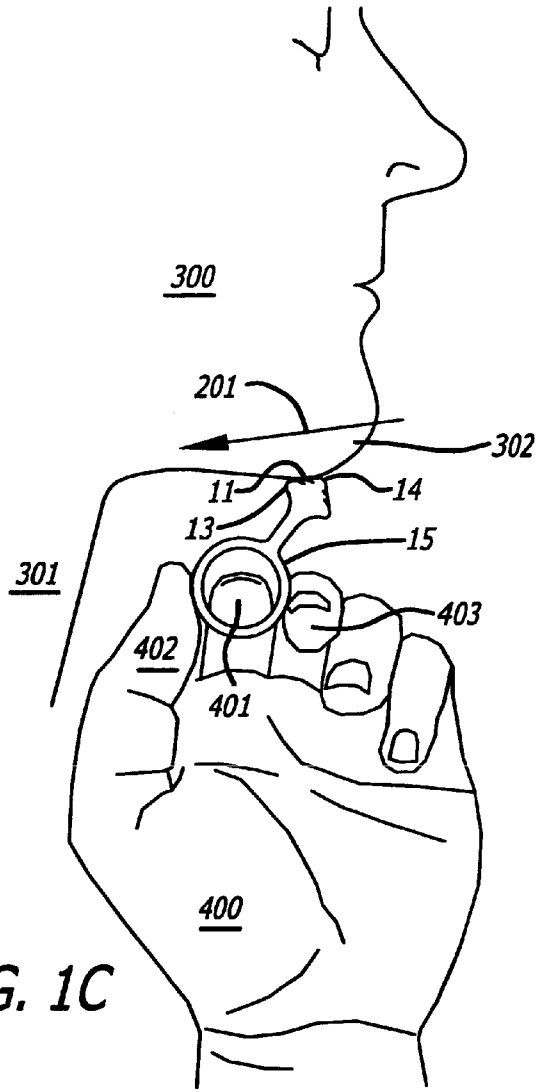
FIGS. 1B & 1C are side views of the method of operation of the preferred embodiment.
Figure 1B:
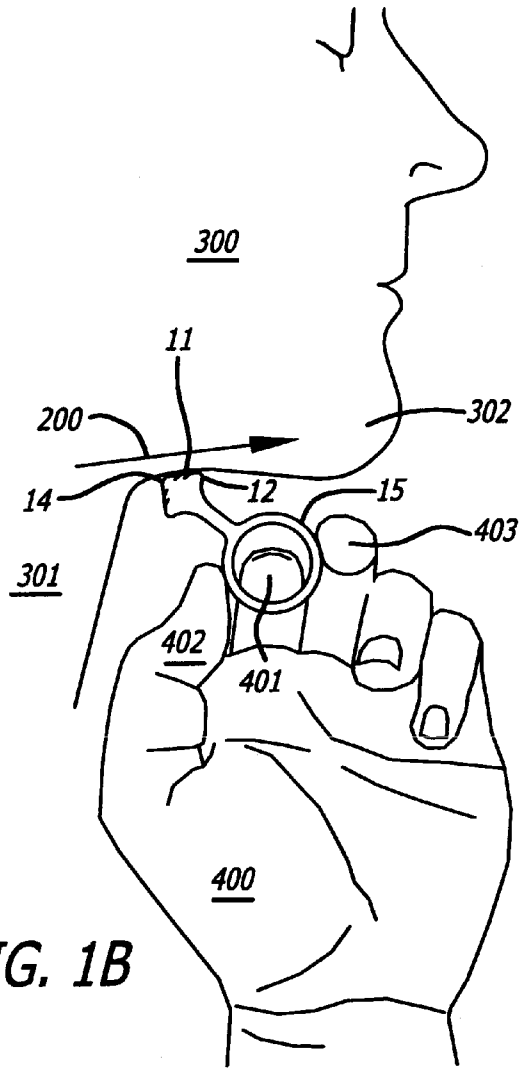

FIG. 1B illustrates a downward stroke from neck 301 to chin 302 along the line of arrow 200. The downward stroke is a pulling stroke with the bidirectional shaving head 14 following the hand 400 and the blades 11 attached to the front side 12 of the bidirectional shaving head 14 are drawn against the beard.

FIG. 1C illustrates the return stroke which may occur without lifting the bidirectional shaving head 14 from the face 300. The return stroke along the line of arrow 201 is accomplished by completing the downward stroke and then incrementally rolling the bidirectional shaving head 14 around the index finger 401, (with the help of the thumb 402 and middle finger 403 illustrated in FIG. 1D), until the blades 11 affixed to the back side 13 are placed in contact with the face 300. The return stroke is shown from the chin 302 to neck 301 and is also a pulling stroke with the bidirectional shaving head 14 once again following the hand 400.

It is envisioned that without departing from the intended scope of this invention that a plethora of blade and ring shaped handle configurations, may be used as the support for a unidirectional or bidirectional shaving head and method. A critical feature of this invention is the incremental movement of the arched, or circular handle, with blades attached, around one or more fingers.

Figure 2:
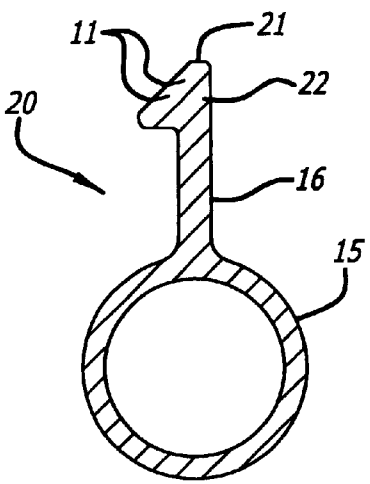
FIG. 2 is a cut-away side view of a first alternate embodiment of the rolling razor.

Referring now to FIG. 2, there is illustrated a cut-away side view of a first alternate embodiment of the rolling razor, generally designated 20.

This embodiment shows a disposable razor for shaving. The non-replaceable shaving blades 11 are affixed to the front 21 of the unidirectional shaving head 22 which is connected to the ring shaped handle 15 via a short neck 16.

Figure 3B:
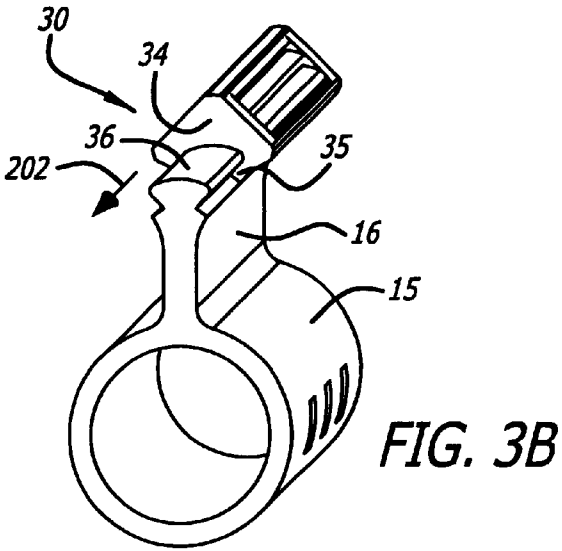
FIG. 3B is an assembly view of the embodiment of FIG. 3A.
Figure 3A:
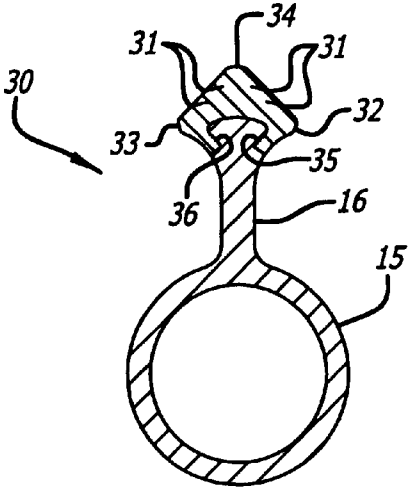
FIG. 3A is a cut-away side view of a second alternate embodiment of the rolling razor.

Referring now to FIG. 3A, there is illustrated a cut-away side view of a second alternate embodiment of the rolling razor, generally designated 30.

This embodiment shows a razor for shaving, which uses replaceable shaving blades. The shaving blades 31 are affixed to the front 32 and rear 33 of the replaceable bidirectional shaving head 34 which is connected to the ring shaped handle 15 via a latch and catch arrangement 35 & 36 between the base of the replaceable bidirectional shaving head 34 and the top of the short neck 16.

Referring now to FIG. 3B there is illustrated an assembly view of the embodiment of FIG. 3A, generally designated 30.

The latch 35 on the base of the replaceable bidirectional shaving head 34 mates with the catch 36 on the top of the short neck 16, by sliding the replaceable bidirectional shaving head cartridge 34 along the line of arrow 202 a new cartridge may be added. A stopping catch (not shown) limits the insertion of the replaceable bidirectional shaving head cartridge 34 to a pre-selected distance on the short neck 16. Reversing the process allows the user to replace the replaceable bidirectional shaving head cartridge 34.

Figure 3C:
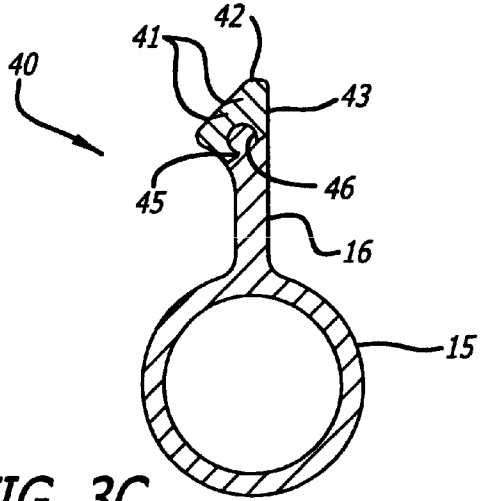
FIG. 3C is a cut-away side view of a unidirectional embodiment of the embodiment of FIG. 3A.

Referring now to FIG. 3C, there is illustrated a cut-away side view of a unidirectional embodiment of the embodiment of FIG. 3A, generally designated 40.

This embodiment shows a unidirectional razor for shaving, with a replaceable shaving head cartridge. The shaving blades 41 are affixed to the front 42 of the replaceable unidirectional shaving head cartridge 43 which is connected to the ring shaped handle 15 via a latch and catch arrangement 44 & 45 between the base of the replaceable unidirectional shaving head cartridge 43 and the top of the short neck 16.

Figure 4:
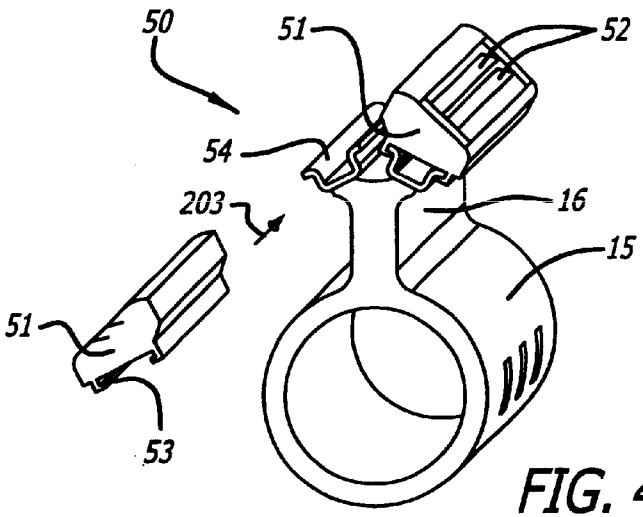
FIG. 4 is an assembly view of a third alternate embodiment of the rolling razor.

Referring now to FIG. 4 there is illustrated an assembly view of a third alternate embodiment of the rolling razor, generally designated 50.

In this embodiment a dual latch and catch system is used to support two opposite slide-on blade cartridges 51. Each slide-on blade cartridges 51 has a pair of razor blades 52 affixed therein, a latch 53 formed at the base of each slide-on blade cartridges 51 mates with the a catch 54 affixed to, or formed as part of, the top of the short neck 16, by sliding the slide-on blade cartridges 51 along the line of arrow 203 each new cartridge may be added. A stopping catch (not shown) limits the insertion of the slide-on blade cartridges 51 to a pre-selected distance on the short neck 16. Reversing the process allows the user to replace the slide-on blade cartridges 51. The short neck 16 is formed as part of, or attached to, the ring shaped handle 15 thereby completing the device.

Figure 5:
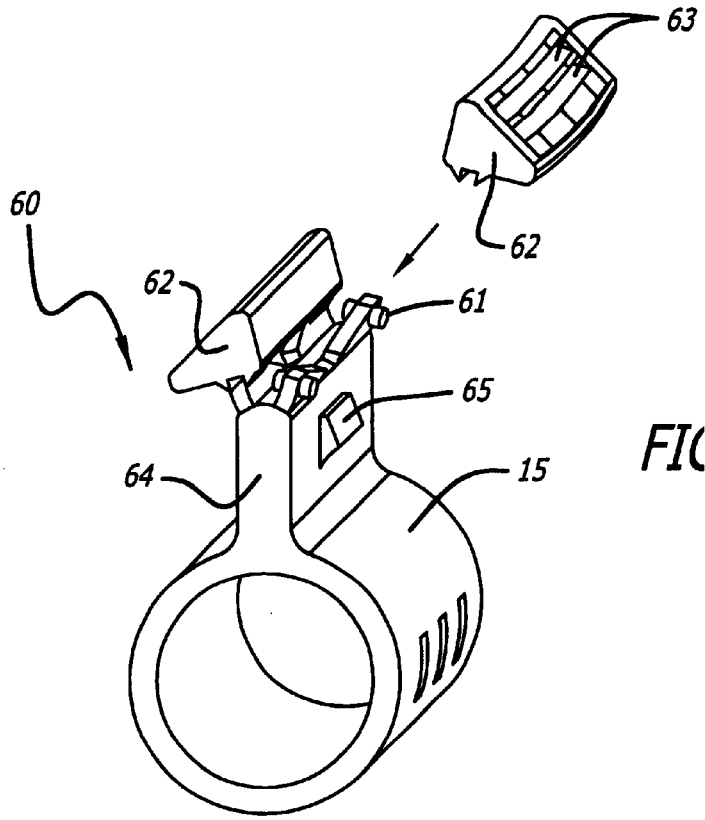
FIG. 5 is an assembly view of a fourth alternate embodiment of the rolling razor.

Referring now to FIG. 5 there is illustrated an assembly view of a fourth alternate embodiment of the rolling razor, generally designated 60.

In this embodiment a dual horizontal latch and catch system 61, which mates with a Schick™ refill cartridge, is used to support two opposite latch-on refill cartridges 62. The dual horizontal latch system 61, is known art and therefore a detailed description of its construction and usage is not included.

Each refill cartridge 62 has a pair of razor blades 63 affixed therein. Each refill cartridge 62 has catches which mate with horizontal latches 61 thereby affixing the refill cartridges 62 to one end of a short hollow neck 64. Within the short hollow neck 64 is housed a mounting lever 65 which is a part of the dual horizontal latch and catch system 61 and which extends on each side of the short hollow neck 64. When engaged the mounting lever 65 urges a movement of the connected horizontal latch to either grasp or release a catch on the refill cartridge 62. The short hollow neck 64 is affixed at one end to the ring shaped handle 15.

Figure 6:
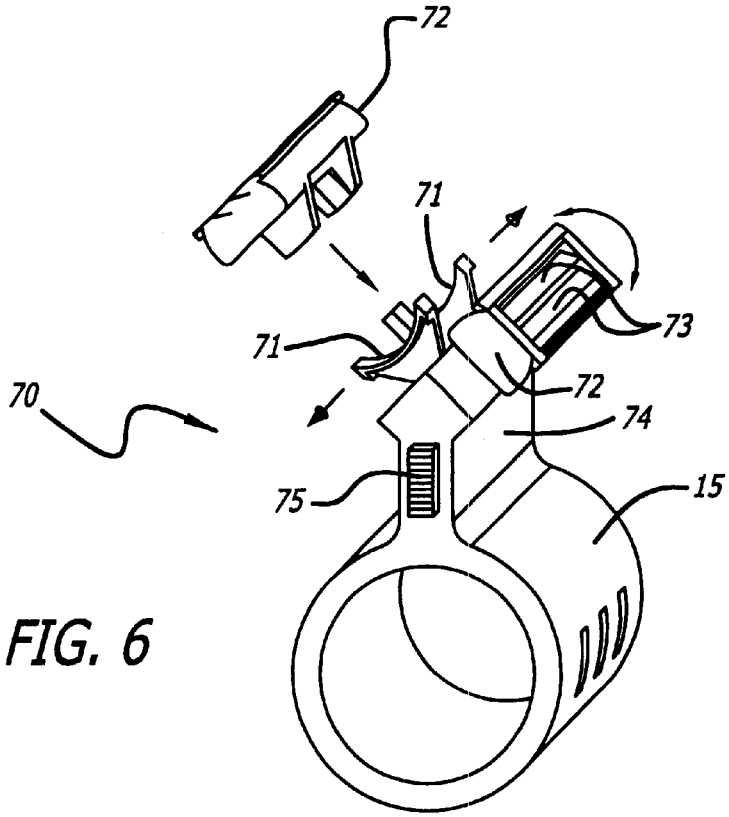
FIG. 6 is an assembly view of a fifth alternate embodiment of the rolling razor.

Referring now to FIG. 6 there is illustrated an assembly view of a fifth alternate embodiment of the rolling razor, generally designated 70.

In this embodiment a dual vertical latch and catch system 71, which mates with a Gillette™ refill cartridge, is used to support two opposite latch-on refill cartridges 72. The dual vertical latch system 71, is known art and therefore a detailed description of its construction and usage is not included.

Each refill cartridge 72 has a pair of razor blades 73 affixed therein. Each refill cartridge 72 has catches which mate with vertical latches 71 thereby affixing the refill cartridges 72 to one end of a short hollow neck 74. Within the short hollow neck 74 is housed a mounting switch 75 which is a part of the dual vertical latch and catch system 71 and which extends on each side of the short hollow neck 74. When engaged the mounting switch 75 urges a movement of the connected vertical latch to either grasp or release a catch on the refill cartridge 72. The short hollow neck 74 is affixed at one end to the ring shaped handle 15.

Figure 7:
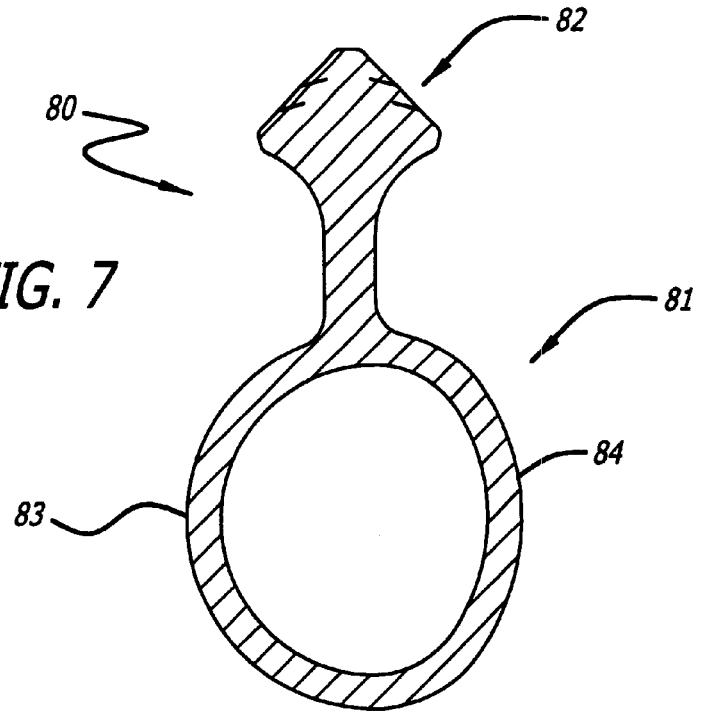
FIG. 7 is a cut-away side view of a sixth alternate embodiment of the rolling razor.

Referring now to FIG. 7 there is illustrated a cut-away side view of a sixth alternate embodiment of the rolling razor, generally designated 80.

This embodiment shows an ovoid ring handle 81 with a bidirectional shaving head 82. The ovoid handle 81, which allows the user to choose the small radius curvature side of the ovoid handle 83 or the larger radius curvature side of the ovoid handle 84 depending on which best fits their hand and fingers.

It is envisioned that a unidirectional shaving head mounted to the ovoid handle 81 would fall within the intended scope of this invention.

Figure 8A:
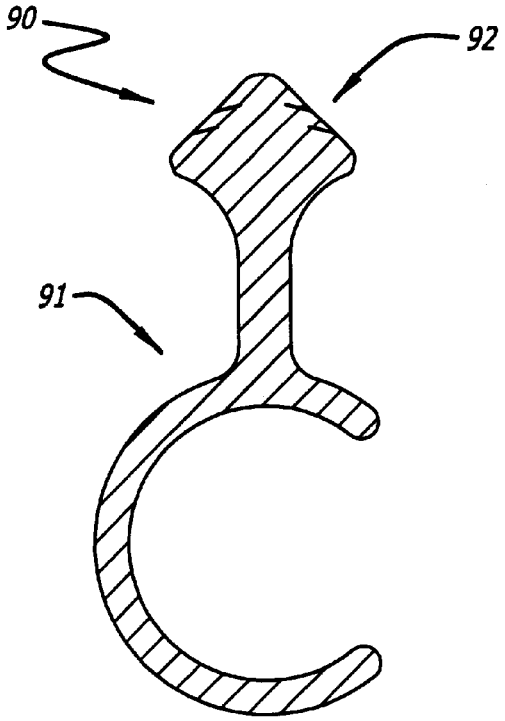
FIG. 8A is a cut-away side view of a seventh alternate embodiment of the rolling razor.
Figure 8B:
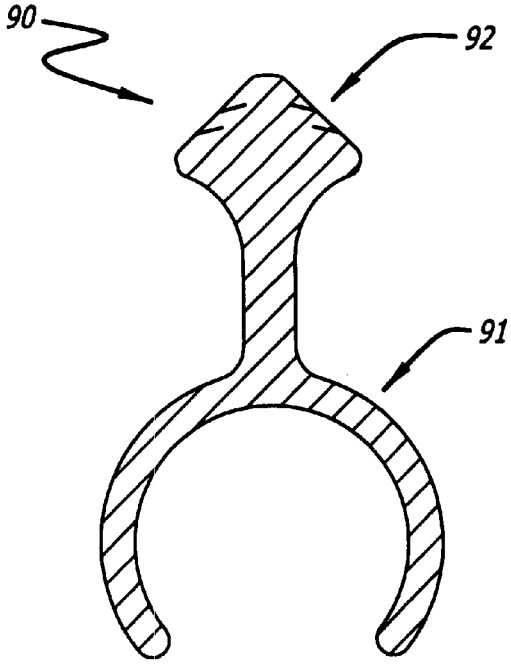
FIG. 8B is a cut-away side view of an alternate embodiment of the embodiment of FIG. 8A.

Referring now to FIGS. 8A and 8B there are illustrated cut-away side views of a seventh alternate embodiment of the rolling razor, generally designated 90.

Each embodiment shows a partial ring handle 91 with a bidirectional shaving head 92. The partial ring handle 91 may be open on the top (FIG. 8A) or open at the bottom (FIG. 8B). It is envisioned that a unidirectional shaving head mounted to the partial ring handle 91, would fall within the intended scope of this invention.

Figure 9:
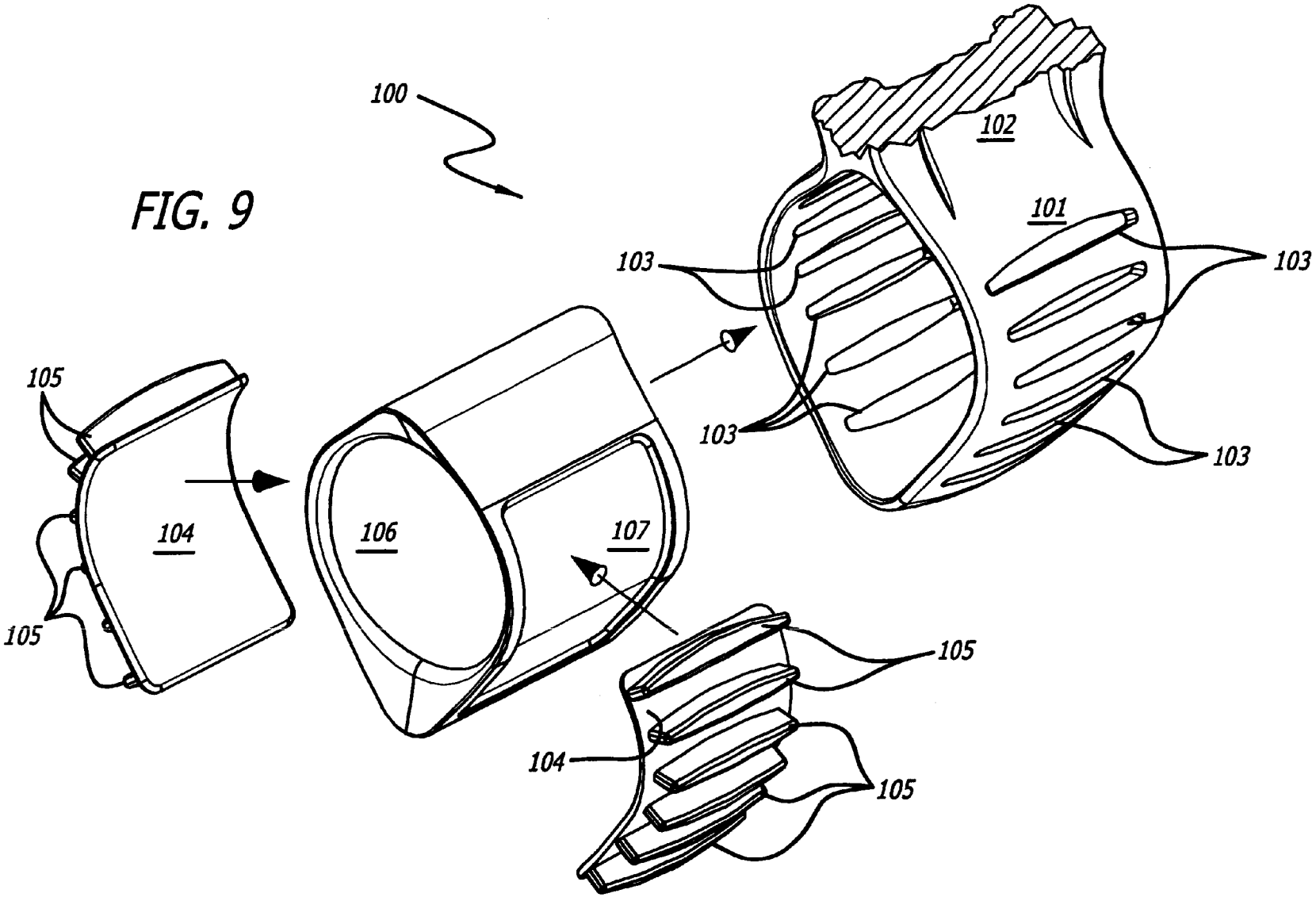
FIG. 9 is an alternate embodiment of the ring handle for the rolling razor.

Referring now to FIG. 9 there is illustrated an alternate embodiment of the ring handle for the rolling razor generally designated 100.

The handle casing 101 is an injection molded part 101. A short neck 102 (partially revealed in this illustration) extends from the handle casing 101 and the shaving head (not shown) is affixed thereto.

A series of gripping guides 103 are formed through each side of the handle casing 101 and a pair of molded soft gripping members 104 with a gripping surface plurality of gripping ridges 105, each of a size and shape to extend through the gripping guides 103 and are inserted in to the gripping guides 103 from the inside of the ring towards the outside.

A comfort sleeve 106 molded from a relatively soft and tactical material forming an internal gripping surface fits neatly within the handle casing 101 and prohibits removal of the soft gripping members 104 by placing the soft gripping members 104 in a grip catch 107. The wall thickness of the comfort sleeve 106 may be formed in a pre-selected width each to accommodate a specific finger size range.

Since certain changes may be made in the above apparatus without departing from the scope of the invention herein involved, it is intended that all matter contained in the above description, as shown in the accompanying drawing, shall be interpreted in an illustrative, and not a limiting sense.

What is claimed is:

1. A shaving razor comprising:

a cutting means;

a short neck with a first end affixed to the cutting means and a second end; and, an open substantially cylindrically shaped handle affixed to the second end of the short neck, wherein the cutting means is a first and a second cartridge, each with at least one razor blade mounted therein.

2. A shaving razor comprising:

a cutting means;

a short neck with a first end affixed to the cutting means and a second end;

an open substantially cylindrically shaped handle affixed to the second end of the short neck, wherein the cutting means is a cartridge with at least one razor blade mounted therein;

a set of vertical mating latches extending from the first end of the short neck;

mating catches formed on the cartridge to reversible mate with the mating latches; and, a mounting switch within the short neck connected to the vertical latches wherein applying pressure to the mounting switch urges the movement of the vertical mating latches to grasp or release the mating catches on the cartridge.

3. The shaving razor of claim 1, further comprising:

a first and a second set of vertical mating latches extending from the first end of the short neck;

mating catches formed on each cartridge to reversible mate with a set of mating latches; and, a first mounting switch within the short neck connected to the first vertical mating latches whereby applying pressure to the first mounting switch urges the movement of the first set of vertical mating latches to grasp or release the mating catches on the first cartridge; and, a second mounting switch within the short neck connected to the second vertical mating latches whereby applying pressure to the second mounting switch urges the movement of the second set of vertical mating latches to grasp or release the mating catches on the second cartridge.

4. A shaving razor comprising:

a body defining an arcuate region to receive a finger of a user;

a neck extending from the body;

a first blade assembly having a face defining a first plane, the first blade assembly coupled to the neck; and a second blade assembly having a face defining a second plane, the second blade assembly coupled to the neck.

5. The shaving razor of claim 4 wherein the first plane and second plane define an acute angle.

6. The shaving razor of claim 4 further comprising:

a first release button and a second release button to release the first blade assembly and second blade assembly respectively.

7. The shaving razor of claim 4 wherein the razor is symmetric about two axes.

8. A shaving razor comprising:

a body defining an arcuate region to receive an index finger, the body having a first side and a second side to be engaged in opposition by a thumb and a middle finger respectively of a user, such that the thumb and middle finger control rotation about the index finger;

a neck extending from one end of the body;

a receiver coupled to the neck to retain a first blade assembly having a face defining a first plane; and a second receiver coupled to the neck to retain a second blade assembly.

9. The shaving razor of claim 8, wherein an inner surface of the arcuate region is substantially smooth.

10. The shaving razor of claim 1, further comprising surface ridges for gripping and rotational control extending from the outer surface of the cylindrical shaped handle.

11. The shaving razor of claim 1, further comprising surface indentations for gripping and rotational control extending from the outer surface of the cylindrical shaped handle.

12. The shaving razor of claim 1, further comprising an internal gripping surface applied to the inside of the cylindrical shaped handle, whereby the user has a soft and tactile surface to grip on the inside of the cylindrical shaped handle.

13. The shaving razor of claim 12, wherein the thickness of the internal gripping surface is of a pre-selected dimension and corresponds to a size range.

* * * * *